US009546454B2

(12) United States Patent
Sanders

(10) Patent No.: US 9,546,454 B2
(45) Date of Patent: Jan. 17, 2017

(54) PRE-CAST CONCRETE ROAD REPAIR PANEL

(71) Applicant: Mark Sanders, Zionsville, IN (US)

(72) Inventor: Mark Sanders, Zionsville, IN (US)

( * ) Notice: Subject to any disclaimer, the term of this patent is extended or adjusted under 35 U.S.C. 154(b) by 0 days.

(21) Appl. No.: 14/661,795

(22) Filed: Mar. 18, 2015

(65) Prior Publication Data

US 2015/0267358 A1 Sep. 24, 2015

Related U.S. Application Data

(60) Provisional application No. 61/955,284, filed on Mar. 19, 2014.

(51) Int. Cl.

| | |
|---|---|
| ***E01C 5/00*** | (2006.01) |
| ***E01C 7/14*** | (2006.01) |
| *E01C 5/06* | (2006.01) |
| *E01C 9/00* | (2006.01) |

(52) U.S. Cl.

CPC ..... *E01C 7/147* (2013.01); *E01C 5/005* (2013.01); *E01C 5/06* (2013.01); *E01C 9/00* (2013.01)

(58) Field of Classification Search

CPC ..... E01C 5/005; E01C 5/06; E01C 7/147; E01C 9/00

USPC ..... 404/34–36, 47, 56–73, 75, 78; 14/73

See application file for complete search history.

(56) References Cited

U.S. PATENT DOCUMENTS 1,089,380 A * 3/1914 McDonald ..... E01C 9/083 404/35
1,915,032 A * 6/1933 Poulter ..... E01C 23/10 104/11
4,962,913 A * 10/1990 Stewart ..... B66C 1/28 254/269
4,972,537 A * 11/1990 Slaw, Sr. ..... E01D 19/125 14/73
5,586,834 A * 12/1996 Tsuji ..... E01C 11/14 404/60
5,720,067 A * 2/1998 Grearson ..... E01D 19/125 14/73
6,558,071 B1 * 5/2003 Sproules ..... E01O 5/08 404/78
6,668,412 B1 * 12/2003 Tadros ..... E01D 19/125 14/73
6,688,808 B2 * 2/2004 Lee ..... E01C 5/06 404/34
7,134,805 B2 * 11/2006 Yee ..... F16L 13/113 403/381
7,448,176 B2 * 11/2008 Drake ..... E01C 7/147 404/34

(Continued)

*Primary Examiner* — Raymond W Addie

(74) *Attorney, Agent, or Firm* — Maginot, Moore & Beck LLP

(57) ABSTRACT

A precast concrete road repair panel is configured to be received in a prepared portion of an existing road under repair. The underside of the panel is textured to receive a grout or other settable composition suitable to affix the repair panel to the existing road sub-base or underlayment. The panel is provided with leveling plates that can be adjusted to ensure that the top surface of the repair panel is flush with the existing road surface. Openings are provided throughout the panel for introducing grout or other similar composition to fix the precast panel in place. Dowels, rods or rebar may be incorporated into the junction between adjacent precast panels or between the precast panel and the existing road surface.

11 Claims, 4 Drawing Sheets

(56) References Cited

U.S. PATENT DOCUMENTS

| | | | | |
|---|---|---|---|---|
| 7,607,856 | B2 * | 10/2009 | Patel | E01F 15/003 404/6 |
| 8,591,143 | B1 * | 11/2013 | Knapp | E01C 23/06 254/2 R |
| 8,756,898 | B1 * | 6/2014 | Backhaus | E04B 5/023 404/47 |
| 8,911,173 | B2 * | 12/2014 | Ulislam | E01O 5/005 404/17 |
| 9,255,404 | B2 * | 2/2016 | Willems | E04C 2/049 |
| 2014/0369750 | A1 * | 12/2014 | Siqueiros | E01O 5/003 404/82 |
| 2015/0167260 | A1 * | 6/2015 | Siqueiros | E04G 21/142 404/73 |

* cited by examiner

PRE-CAST CONCRETE ROAD REPAIR PANEL

REFERENCE TO RELATED APPLICATION

This application is a non-provisional of and claims priority to Provisional Application No. 61/955,284, filed on Mar. 19, 2014, the entire disclosure of which is incorporated herein by reference.

BACKGROUND

With the spring thaw comes the onslaught of potholes in our roadways, followed by the omnipresent road repair crews. The disruption of travel on the streets and highways is a necessary nuisance to restore the roads to a drivable condition. Patching ruts and potholes in a concrete road surface is generally a temporary fix since the patch typically disintegrates relatively quickly.

For the preferred repair process a section of concrete is removed and new concrete poured. However, this process can be lengthy since the concrete must be completely set before the new road surface is ready to receive traffic. Consequently, the street or highway is subjected to lane restrictions, leading to the traffic congestion and even accidents that commuters have grown to dread. There is an extreme need for a concrete road repair system that is efficient and quick.

SUMMARY

The present disclosure contemplates a pre-fabricated or pre-cast concrete road repair panel that is configured to be received in a prepared portion of an existing road under repair. The underside of the panel is textured to receive a grout or other settable composition suitable to affix the repair panel to the existing road sub-base or underlayment. The panel is provided with leveling plates that can be adjusted to ensure that the top surface of the repair panel is flush with the existing road surface. Openings are provided throughout the panel for introducing grout or other similar composition to fix the pre-cast panel in place. Dowels, rods or rebar may be incorporated into the junction between adjacent pre-cast panels or between the pre-cast panel and the existing road surface.

DETAILED DESCRIPTION

Figure 1:
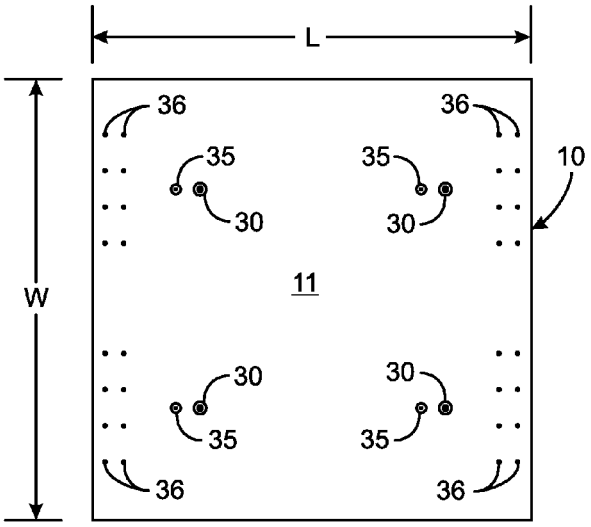
FIG. 1 is top plan view of a pre-cast concrete road repair panel according to one embodiment of the present disclosure.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
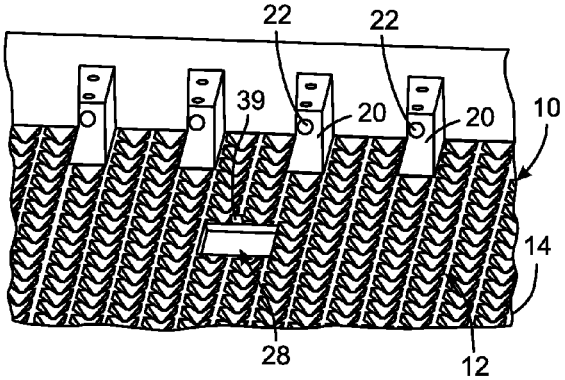
FIG. 2 is an enlarged bottom view of a portion of the pre-cast road repair panel shown in FIG. 1.
Figure 3:
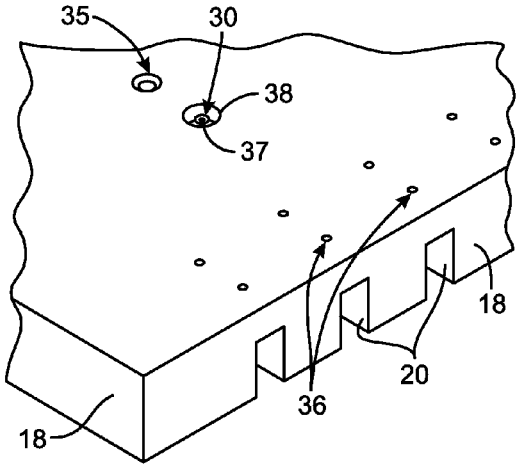
FIG. 3 is an enlarged perspective view of a portion of the pre-cast road repair panel shown in FIG. 2.

Referring to FIGS. 1-3, a pre-cast concrete road repair panel 10 is shown. The panel is pre-fabricated or pre-cast and is preferably provided in a uniform size corresponding the typical lane width of a street or highway. In particular, the concrete panel may be pre-cast in a conventional casting mold with a width W of twelve (12) feet. The length L of the pre-cast panel 10 may vary depending upon the road surface being repaired and the extent of the damage. Thus, in one aspect the pre-cast panel may be provided in lengths from four (4) feet to eighteen (18) feet. The pre-cast panels may be provided in a selection of standard lengths, such as 4, 8, 12, and 18 feet lengths, so that the pre-cast panels may be prefabricated and stored for use when needed. The thickness of the panels corresponds to the thickness of the remaining road surface at the road repair site. For typical road surfaces the minimum thickness permitted by government regulations is six (6) inches, although most road surfaces have thickness of eight (8) to eleven (11) inches.

Figure 4:
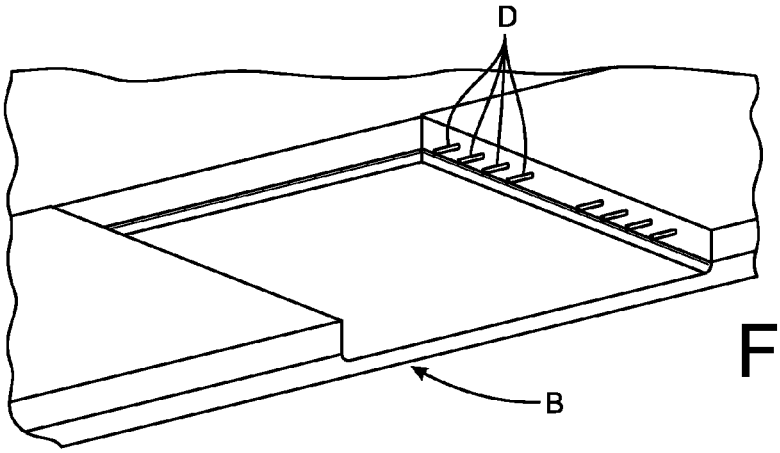
FIG. 4 is a perspective view of an existing road surface being repaired in a first step of the repair according to one aspect of the present disclosure.

As shown in FIG. 2, the underside or bottom surface 12 of the pre-cast concrete panel 10 is provided with surface texturing 14 to provide increased surface area and gripping capability for a sealant, epoxy, adhesive, grout or other composition adapted to affix or adhere the pre-cast panel 10 to the existing road surface, road underlayment or sub-base B, as shown in FIG. 4. In one specific embodiment the texturing 14 may constitute a repeating array of grooves or ridges that are configured to provide a plurality of gaps between the bottom surface 12 of the panel and the road surface or sub base B. As shown in FIG. 3, the side walls 18 of the pre-cast concrete repair panel 10 may be provided with a series of voids or cavities 20 extending a predetermined distance into the panel. In one embodiment, the cavities may extend three to four (3-4) inches into the panel. Additional bores 22 may be provided at the base of each cavity 20 as shown in FIG. 2 to receive an elongated anchor element, such as a dowel, rod or rebar. The cavities are configured to receive a composition adapted to affix the pre-cast panel 10 to the road underlayment or sub-base as well affix to a dowel or rebar integrated into the existing road surface.

The pre-cast panel 10 further includes a leveling feature that allows the panel to be adjusted at the repair site so that it is flush with the existing road surface. Thus in one aspect, a plurality of leveling plates 28 are provided that project adjustably from the underside of the panel, as shown in FIG. 2. In one embodiment, four leveling plates are provided at uniform locations of the panel, such as in the center of corresponding quadrants of the panel. An adjustment mechanism 30 is accessible at the top surface 11 as shown in FIGS.

1 and 3, which may constitute a lead screw arrangement to raise and lower the leveling plate relative to the underside 12 of the panel. In some applications it is preferable that the adjustment mechanism include an air, hydraulic or air over hydraulic cylinder arrangement, in which case the mechanism 30 includes a fitting 37 that is accessible through an opening 37. The fitting is connected to a cylinder 39 (FIG. 2) to which the leveling plate 28 is attached. Air or hydraulic pressure applied through the fitting 37 extends the cylinder 39 and thus the leveling plate 28. The adjustment mechanisms are configured to permit adjustments of less than one (1) inch. It is contemplated that the adjustment mechanism 30 is capable of maintaining the position of the pre-cast panel 10 above the sub base B for a time sufficient to allow the affixing composition to set. It is contemplated that the adjustment mechanism may also be capable of maintaining its adjusted configuration as a load bearing component of the pre-cast road panel.

The panel 10 is further provided with a plurality of openings 35 that communicate with the bottom surface 12 of the panel, and particularly with the texturing 14. The openings 35 are sized for injection of a composition adapted to affix the pre-cast panel 10 to the road underlayment, such as a grout composition. Similar openings 36 may be provided at each of the cavities 20 to allow grout to be injected into the cavities when the panel is installed. The openings 35, 36 are in communication with the gaps formed by the surface texturing 14 so that any space between the concrete panel 10 and the road surface or sub base B can be filled with the composition.

Figure 5:
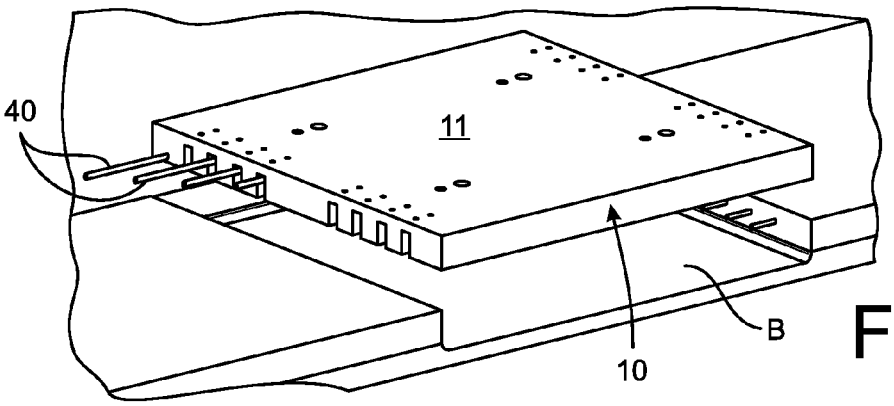
FIG. 5 is a perspective view of the road repair in a second step of the repair process.
Figure 6:
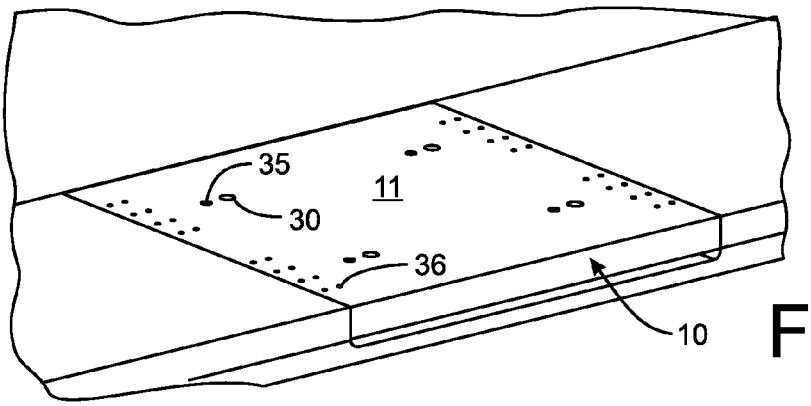
FIG. 6 is a perspective view of the road repair in a third step of the repair process.

FIGS. 4-6 illustrate steps in a road repair using the pre-cast concrete road repair panel 10 disclosed herein. The road surface is prepared by removing the damaged portion of the existing road and carving out the road according to the dimensions of the repair panel 10. Anchoring elements, such as dowels D, may be implanted into the existing concrete of the road, as shown in FIG. 4. With the road sub-base B exposed, the panel 10 is installed. In one aspect, the grout holes 35 may be threaded to receive a lifting element, such as a bolt or ring, which can be lifted and lowered by a cable. As shown in FIG. 5, additional anchoring elements, such as dowels 40, may be incorporated into the panel 10, particularly where a series of such panels 10 are utilized to repair a large gap in the road surface. The panel is lowered onto the sub-base B with the dowels D seated within the cavities 20. Once the panel 10 is seated, the leveling plate 28 may be adjusted using the adjustment mechanism 30 to ensure that the top surface 11 of the panel is flush with the existing road. Grout or other similar sealant composition may then be injected through each of the openings 30, 35, 36 to complete the process. The grout may be a rapid setting composition so that the repaired road surface is ready to receive traffic within minutes of installation.

Figure 7:
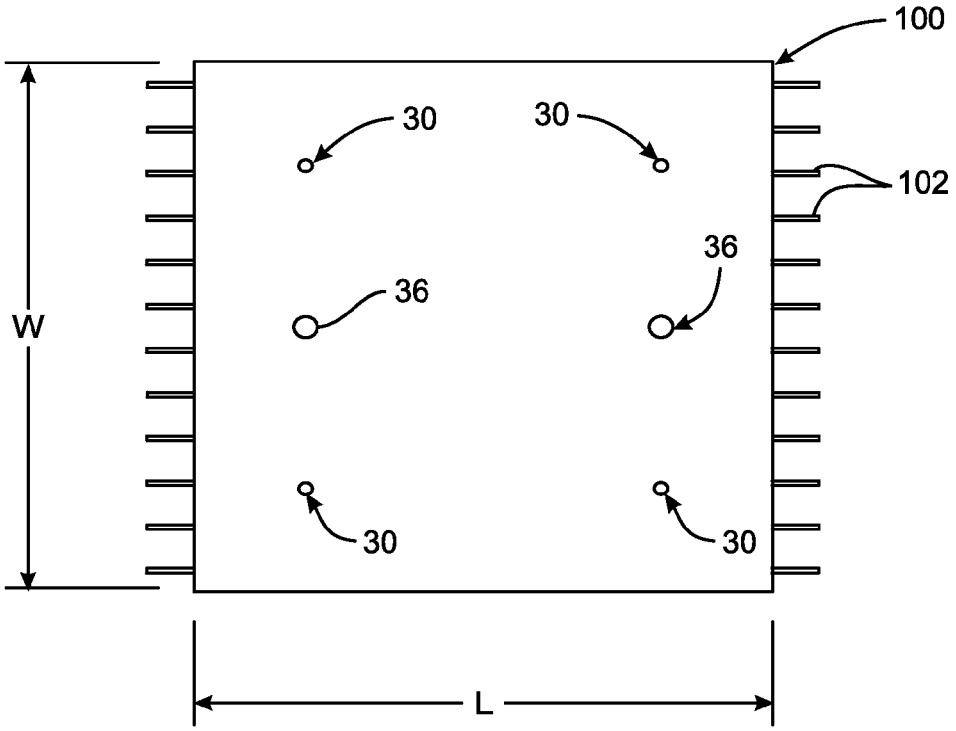
FIG. 7 is a top view of a pre-cast concrete roar repair panel according to a further embodiment of the present disclosure.
Figure 8:
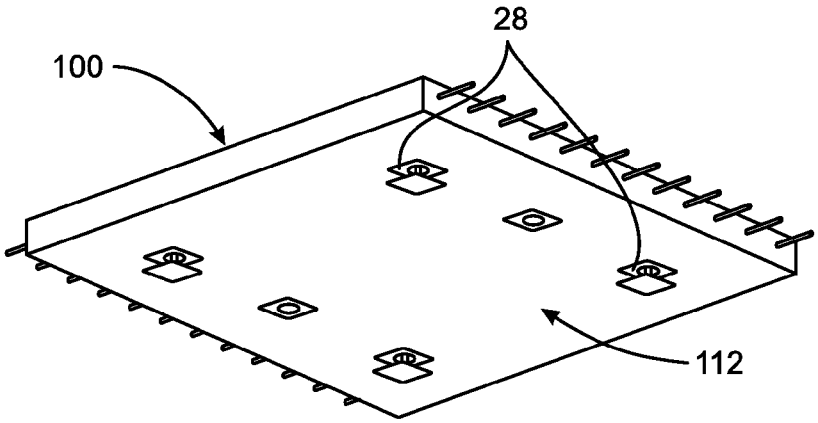
FIG. 8 is a perspective view of the bottom of the road repair panel shown in FIG. 7.
Figure 9:
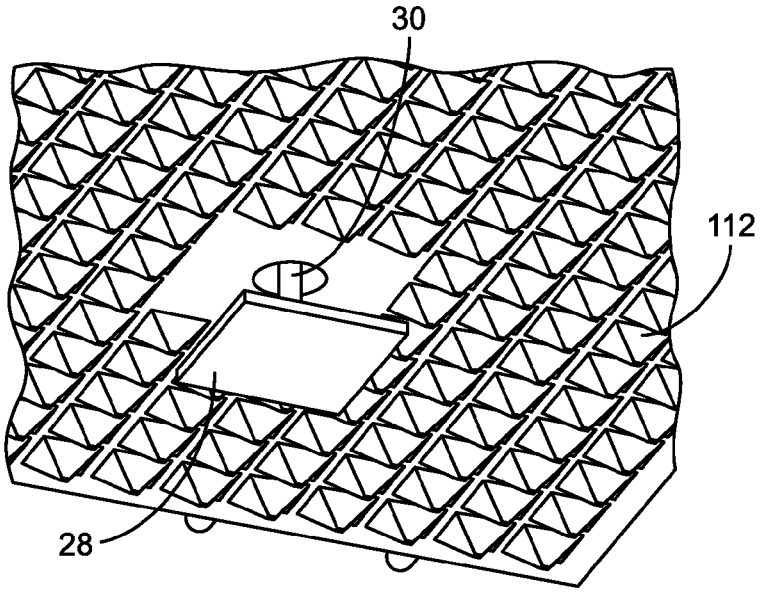
FIG. 9 is an enlarged perspective view of a portion of the bottom of the road repair panel shown in FIG. 7.
Figure 10:
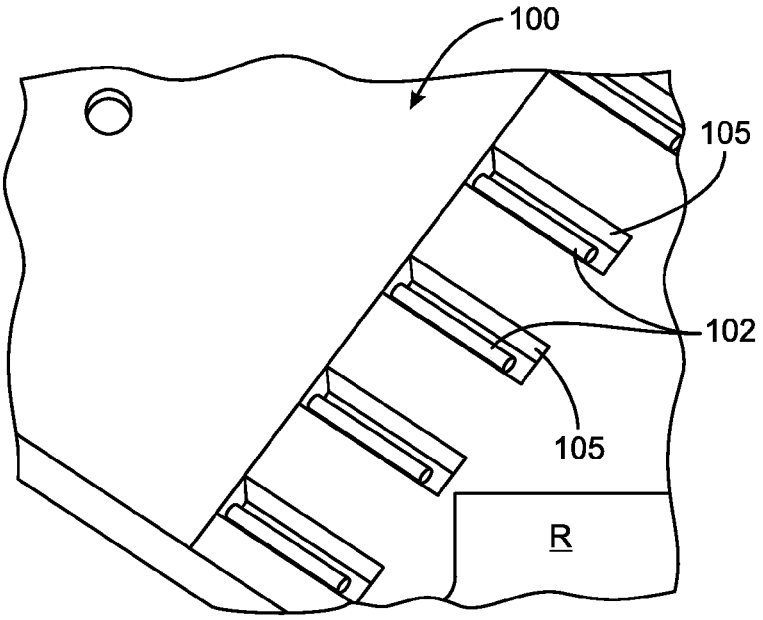
FIG. 10 is an enlarged perspective view of the road repair panel shown in FIG. 7 introduced into an existing road surface.

A modified pre-cast concrete road repair panel 100 is shown in FIGS. 7-10. The panel 100, like the panel 10, has a width W that can correspond to the road lane width. Thus, the width W is typically twelve (12) feet. The panel 100 can have a length L that may be varied depending upon the application. For most applications, the length L may be four to eighteen (4-18) feet. The panel 100 incorporates elongated anchoring elements, such as dowels, rods or rebar 102, extending at least from two opposite sides of the panel, as shown in FIG. 7. The panel 100 may incorporate the same texturing on the underside 112 as in the panel 10, as well as the leveling plates 28, leveling mechanism 30 and grout holes 36. In this embodiment, the existing road surface R is prepared by forming pockets 105 to receive the dowels 102, as shown in FIG. 10. The pockets 105 are then filled with an epoxy or other settable composition adapted to affix or seal the dowel 102 to the existing road concrete.

The present disclosure contemplates a pre-cast concrete road repair panel that is configured to be received in a prepared portion of an existing road under repair. The underside of the panel is textured to receive a grout or other settable composition suitable to affix the repair panel to the existing road sub-base or underlayment. The panel is provided with leveling plates that can be adjusted to ensure that the repair panel is flush with the existing road surface. Openings are provided throughout the panel for introducing grout or other similar composition to fix the pre-cast panel in place.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A road repair panel comprising:
a pre-fabricated concrete panel including;
an upper surface;
an opposite bottom surface having a textured surface for providing a plurality of gaps between the bottom surface and a road surface being repaired;
a number of openings extending from said upper surface to said bottom surface for introduction of a settable composition into the plurality of gaps at said textured bottom surface, the settable composition suitable to affix the repair panel to the existing road surface;
at least one leveling plate extending from said bottom surface; and
an adjustment mechanism associated with each of said at least one leveling plate and operable to move the leveling plate to adjust the spacing of the said bottom surface from the road surface, said adjustment mechanism accessible through an opening defined in said upper surface when said concrete panel is disposed on the existing road surface.

2. The road repair panel of claim 1, wherein the adjustment mechanism is a pneumatic, hydraulic or air over hydraulic actuator.

3. The road repair panel of claim 1, further comprising a plurality of elongated anchoring elements extending from a side surface of said concrete panel between said upper surface and said bottom surface.

4. The road repair panel of claim 1, further comprising a plurality of cavities defined in said bottom surface and sized to receive elongated anchor elements embedded in the road surface when the repair panel is disposed on the existing road surface.

5. The road repair panel of claim 1, further comprising at least one threaded bore defined in the upper surface of the concrete panel and configured to receive a threaded lifting element.

6. The road repair panel of claim 1, wherein said pre-fabricated concrete panel has a width and a length, said width being equal to a lane width of the road surface being repaired.

7. The road repair panel of claim 6, wherein said width is twelve (12) feet.

8. The road repair panel of claim 1, wherein said pre-fabricated concrete panel has a width and a length, said length being four (4) to eighteen (18) feet.

9. The road repair panel of claim 1, wherein said at least one leveling plate includes four leveling plates uniformly located on said concrete panel, each of said leveling plates associated with a separate corresponding adjustment mechanism.

10. The road repair panel of claim 1, wherein said adjustment mechanism is configured for adjustment of less than one (1) inch.

11. A method for repairing a road surface comprising:

removing a predetermined width and length of road material to expose the sub-base;

lower a pre-fabricated concrete panel onto the exposed sub-base, the panel including;

a textured bottom surface in contact with the sub-base;

a plurality of openings therethrough in communication with the bottom surface;

at least one leveling plate extending from the bottom surface; and an adjustment mechanism associated with each plate and operable to move the leveling plate to adjust the spacing of the said bottom surface from the road surface, the adjustment mechanism accessible through an opening defined in the upper surface of the concrete panel;

operating the adjustment mechanism to move the leveling plate until the upper surface of the pre-fabricated concrete panel is substantially flush with the existing road surface; and introducing a settable composition through said plurality of openings and into the gap between bottom surface of the pre-fabricated concrete panel and the existing sub-base, the settable composition configured to set and to adhere the pre-fabricated concrete panel to the existing road surface and sub-base.

* * * * *